United States Patent [19]

Clearwater

[11] 4,310,961

[45] Jan. 19, 1982

[54] METHOD FOR OPERATING ON CONTINUOUS SLIDE FASTENER CHAIN

[75] Inventor: Russell A. Clearwater, Delevan, N.Y.

[73] Assignee: Talon, Inc., Meadville, Pa.

[21] Appl. No.: 108,321

[22] Filed: Dec. 31, 1979

[51] Int. Cl.[3] ..... B23P 11/00

[52] U.S. Cl. ..... 29/408

[58] Field of Search ..... 29/408–410, 29/766

[56] References Cited

U.S. PATENT DOCUMENTS

| | | | |
|---|---|---|---|
| 2,885,774 | 5/1959 | Waldes | 29/408 |
| 3,485,691 | 12/1969 | Waldes . | |
| 3,765,348 | 10/1973 | Jabor et al. . | |
| 3,831,474 | 8/1974 | Perlman . | |
| 3,872,571 | 3/1975 | Douri . | |
| 3,947,946 | 4/1976 | Omori et al. | 29/408 |
| 4,242,785 | 1/1981 | Shimai | 29/408 |

FOREIGN PATENT DOCUMENTS

| | | | |
|---|---|---|---|
| 769537 | 3/1957 | United Kingdom | 29/408 |

*Primary Examiner*—James G. Smith

*Attorney, Agent, or Firm*—O'Brien & Marks

[57] ABSTRACT

In performing operations on a continuous slide fastener chain at spaced locations therealong, the slide fastener chain is incrementally advanced to successively advance the spaced locations to an operating station. The chain is advanced from a reel which is braked only when a loop of maximum size is sensed in a loop forming mechanism. Tension is relieved in the slide fastener stringer by means of a continuously rotating capstan which will grip the slide fastener stringer to advance the chain and overcome inertia of the reel.

5 Claims, 5 Drawing Figures

METHOD FOR OPERATING ON CONTINUOUS SLIDE FASTENER CHAIN

TECHNICAL FIELD

The present invention relates to methods and apparatus for performing operations, such as gapping, cutting, applying a bottom stop, etc., on spaced locations of a continuous slide fastener chain.

DESCRIPTION OF THE PRIOR ART

The prior art, as exemplified U.S. Pat. Nos. 2,885,774, 3,485,691, 3,765,348, 3,872,571 and 3,831,474, contains several methods and apparatus for performing operations at spaced locations on a continuous slide fastener chain. Operations, such as gapping, cutting, and applying slider stops, generally require intermittent advancement of the continuous slide fastener stringer with the operation being performed during a dwell period of the intermittent advancement. Due to inertia of reels, varying spacing for the operation being performed, etc., prior art methods and apparatus are relatively slow, and where a large quantity of slide fastener chain is being operated on, duplicate apparatus, maintenance, and operator time are required to perform the operations.

SUMMARY OF THE INVENTION

The present invention is summarized in a method of feeding a slide fastener chain and performing an operation on the chain at a work station, including the steps of passing the chain from a freely rotatable reel through a first loop of variable length around a movable roller, biasing the movable roller toward a position forming a maximum size of the first loop, passing the chain from the first loop through a second loop around an engaging surface of a capstan wheel, intermittently advancing the chain from the second loop to the work station, rotating the capstan wheel at a speed which advances the engaging surface at a speed faster than the movement of the chain during the advancing from the second loop, sensing when the first loop reaches a maximum size, braking rotation of the reel only in response to the sensing of the maximum size of the first loop, and performing an operation on the slide fastener chain at the work station during a dwell period of the intermittent advancing.

An object of the invention is to develop a method and apparatus for performing operations at spaced locations on a slide fastener chain with substantially improved speed and efficiency.

Another object of the invention is to reduce the overall investment expense in apparatus for performing operations on continuous slide fastener chain.

An advantage of the invention is that increased productivity reduces the requirement for personnel, thus lowering cost.

One feature of the invention is that problems resulting from supply reel inertia during stopping and starting of rapid incremental advancement of a slide fastener chain are substantially overcome.

Other objects, advantages, and features of the invention will be apparent from the following description of the preferred embodiments taken in conjunction with the accompanying drawings.

DESCRIPTION OF THE PREFERRED EMBODIMENTS

Figure 1:
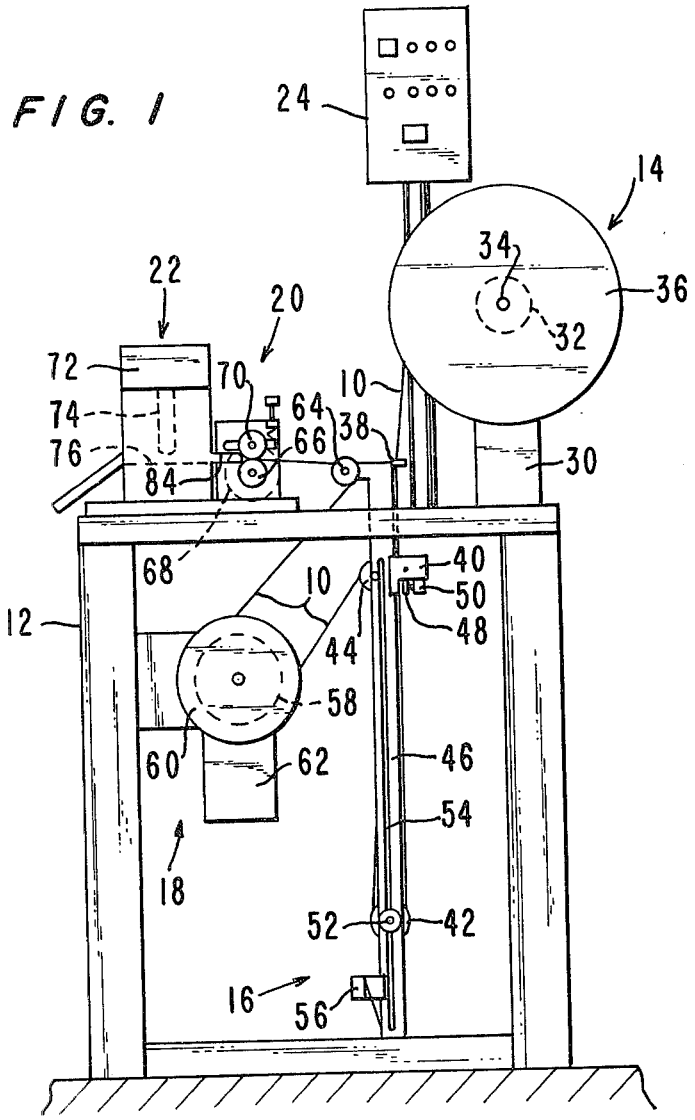
FIG. 1 is a front elevation view of an apparatus for performing operations at spaced locations on a continuous slide fastener chain in accordance with the invention.

As shown in FIG. 1, an apparatus for incrementally feeding and performing an operation at spaced locations on a slide fastener chain 10 in accordance with the invention includes a frame or table 12 supporting a supply reel mechanism indicated generally at 14, a first loop mechanism indicated generally at 16, a capstan mechanism indicated generally at 18, an advancing mechanism indicated generally at 20, an operating mechanism or station indicated generally at 22, and a box 24 containing electrical control circuitry. The advancing mechanism 20 feeds selected lengths of the slide fastener chain 10 to the operating station 22 where an operation is preformed on the chain while the advancing mechanism 20 is stopped. The capstan mechanism 18 relieves tension of the stringer 10 to the advancing mechanism 20 during rapid acceleration and advancement of the chain 10. The first loop mechanism 16 controls the operation of the supply reel mechanism 14 as well as providing a variable length of loop to overcome differences in acceleration and deceleration between the advancing mechanism 20 and the reel mechanism 14.

The supply mechanism 14 has a support 30 upon which an electro-magnetic brake 32, is mounted for braking the rotation of the shaft 34 which extends therefrom. A supply reel 36 containing a relatively long length of the continuous slide fastener chain 10 is removably mounted on the shaft 34 for rotation therewith and for being decellerated when the brake 32 is energized.

From the reel 36, the chain 10 passes through a guide 38, through an end of reel senser 40, under a movable roller 42, and over a stationary roller 44 in the first loop mechanism 16. The end of reel senser 40, the movable roller 42 and the stationary roller 44 are mounted on a pair of vertically elongated plate members 46 (only one shown). The senser 40 has a pivoted arm 48 which operates a switch 50 and which is biased against the chain passing through the senser 40 so that, in the absence of the chain 10 in the senser 40, the switch 50 is opened while the switch 50 is normally closed when the chain is detected by the arm 48 of the senser 40. The movable roller 42 is mounted on a shaft 52 which extends through vertical slots 54 in the members 46 so that the roller 42 is permitted to move upward and downward along the members 46. The shaft 52 has weights mounted on the front and back ends thereof which together with the weight of the roller 42 are selected to produce a tension in the slide fastener chain 10 sufficient to overcome the inertia of the reel 36 and produce angular acceleration of the reel 36. A switch 56 is mounted on the lower end of the plate members 46 for being closed or operated when the roller 42 reaches its lowermost position.

The chain 10 extends from the roller 44 in a second loop around a center circular member or surface 58 of a wheel 60 which is driven by motor 62 mounted in the frame 12. The peripheral gripping surface of the circular member 58 is formed so that, when the tension on the chain 10 exceeds a minimum value, the chain 10 is gripped by the member 58, and when the tension on the chain 10 is less than this minimum value, the member 58 freely slips within the second loop of the chain 10. For example, the surface 58 can be formed from polyurethane. The engaging surface 58 of the wheel 60 moves at a speed which is faster than the speed of the advancing mechanism 20 during its operation so that the capstan mechanism 18 relieves backward tension of the chain 10 on the advancing mechanism 20 due to inertia of the supply reel 36.

The chain 10 extends from the wheel 60 over a guide roller 64 to the advancing mechanism 20. The advancing mechanism 20 has a knurled drive wheel 66 connected to the shaft of a motor 68. A roller 70 mounted on a spring biased arm urges the chain 10 into gripping relationship with the drive wheel 66.

Figure 2:
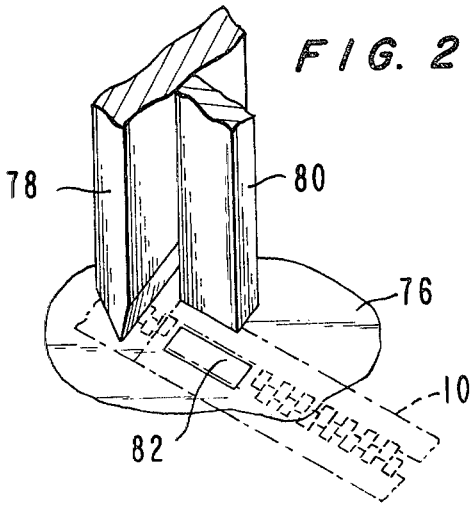
FIG. 2 is a perspective view of a broken-away portion of an operating station in the apparatus of FIG. 1.

The operating mechanism 22 is a conventional mechanism for preforming an operation of the slide fastener chain. For example the mechanism can include an electrical solenoid 72 which drives a ram 74 for cooperating with an anvil 76 to perform an operation on the chain 10. In one particular example illustrated in FIG. 2, the ram has a cutting blade 78 for cutting the chain 10 transversely thereacross. Also, an optional punch 80 is illustrated for cooperating with a die opening 82 in the anvil 76 to remove several of the fastening elements of the slide fastener chain to form a gap in the elements. The mechanism 20 has a guide member 84 extending closely to the exit side of the drive wheel 66 and roller 70 so that the slide fastener chain is pushed into the operating mechanism 20. The slide fastening elements of the chain 10, when restricted to a channel by the guide 84, are relatively incompressable permitting the chain 10 to be pushed through the operating station 22.

Figure 4:
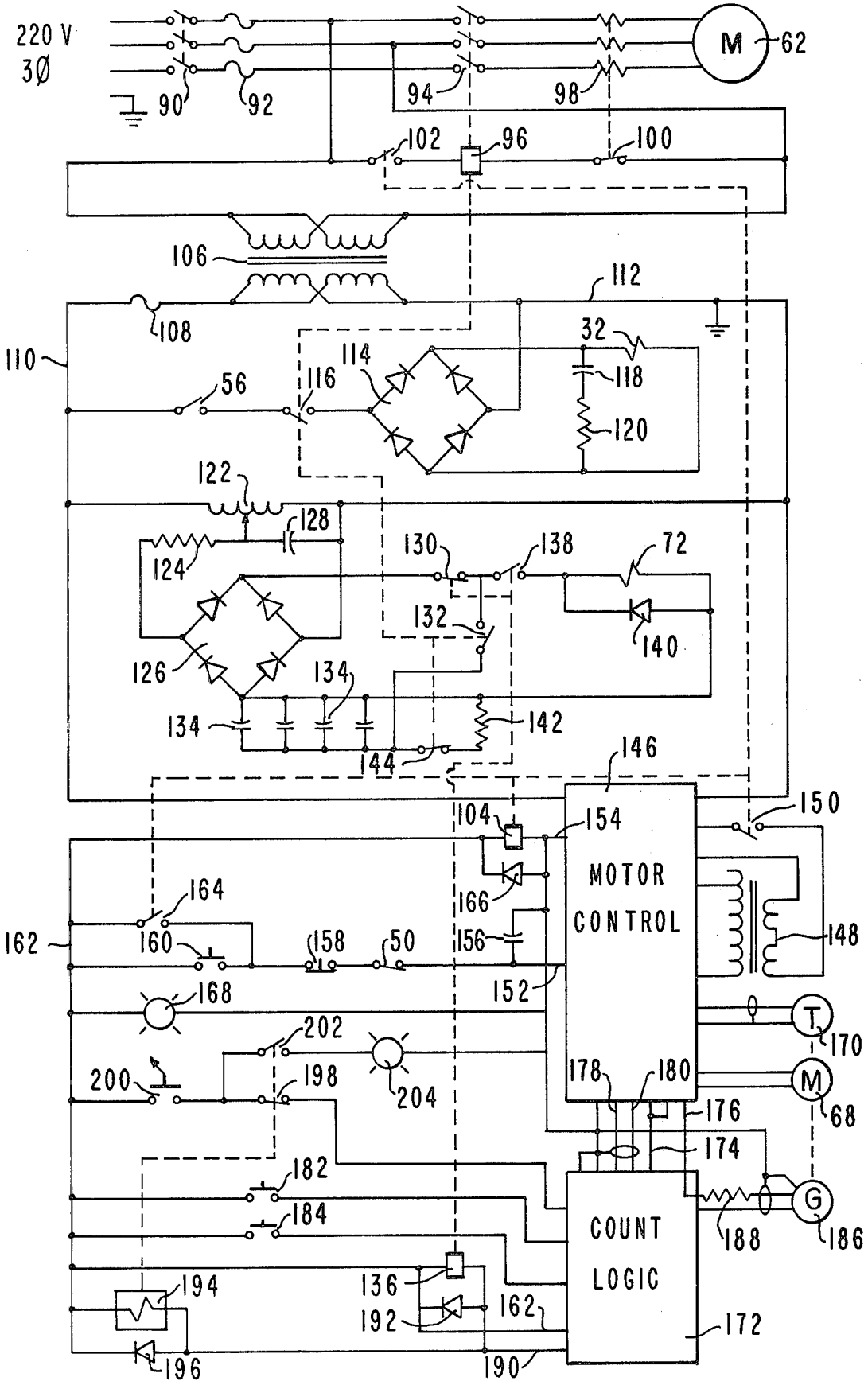
FIG. 4 is a diagram of an electrical circuit for operating the apparatus of FIG. 1.

In the electrical control circuitry of FIG. 4, power input is supplied through power switches 90 and fuses 92 which are connected in series with respective phases of a power source such as a 220 volt three phase 60 hertz electrical power source. The input power lines are connected by normally open contacts 94 of a start relay 96 and overload protective unit 98 to the inputs of the capstan motor 62. The winding of the start relay 96 is connected in series with normally closed contacts 100 of the overload protecter 98 and normally open contacts 102 of a relay 104 across one phase of the power input. This phase of the power input is also connected across the primary winding of a voltage step-down transformer 106 which has its secondary winding connected to lines 110 and 112, the line 10 connected by a fuse 108 to one side of the winding and the line 112 being a ground or common. The inputs of a full wave rectifier 114 are connected in series with the normally open switch 56 and normally open contacts 116 of the starting relay 96 across the power lines 110 and 112. The outputs of the rectifier 114 are connected across the magnetic brake 32 which has a series circuit including a capacitor 118 and a resistor 120 connected thereacross for reducing voltage surges during de-engerization of the magnetic brake 32. A transformer 122 is also connected across the power lines 110 and 112 and has an output tap connected in series with a resistance 124 to one input of a second full wave rectifier 126 which has it other input connected to line 112; a filtering capacitance 128 is coupled across the output of the transformer 122. The output of the full wave rectifier 126 is connected by serial contacts 130 and 132 across a bank of capacitors 134. The contacts 130 are normally closed contacts of a relay 136 while the contacts 132 are normally open contacts of the start relay 96 and are interposed between the contacts 130 and one side of the capacitors 134. Normally open contacts 138 of the relay 136 have one side connected to the junction between the contacts 130 and 132 and the cutting solenoid winding 72 which has its other side connected to the junction between the capacitors 134 and one output of the full wave rectifier 126. A induced-current-passing diode 140 is connected across the relay 72 for providing a path for current during de-energization of the winding 72. A discharge resistance 142 is coupled by normally closed contacts 144 of the start relay 96 across the capacitance bank 134.

The power lines 110 and 112 are connected to the inputs of a motor control circuit unit 146, such as model No. 121 from Introl Design Inc., 4830 Thrall Rd., Lockport, N.Y. A transformer 148 has a variable tap primary winding connected to outputs from the control unit 146 and has a secondary winding connected in series with normally open contacts 150 of the relay 104 to inputs of the motor control circuit unit 146. The unit 146 has internal rectifying and voltage regulating circuits for producing a +24 volt output on line 152 with respect to a common or ground line 154, a +15 volt output on line 174, and a −15 volt output on line 176. A filter capacitance 156 is connected across the lines 152 and 154. The power line 152 is connected by a series circuit including the normally closed end of reel switch 50, a normally closed "OFF" push button switch 158, and a normally open "ON" push button switch 160 to a line 162. The relay winding 104 is connected between the lines 162 and 154, and a diode 166 is connected across the relay winding 104 for providing a return path for induced current when the winding 104 is de-energized. A "POWER ON" indicating lamp 168 is connected across the lines 162 and 154. The motor 68, a direct current reverseable motor, is connected to outputs of the unit 146 while a tachometer 170 driven by the shaft of the motor 68 is coupled to inputs of the motor control unit 146 for providing feedback to control the speed of the motor 68.

A count logic circuit unit 172, such as Model No. 231 from Introl Design Inc., is coupled to the motor control unit 146 by the +15 volt line 174, the −15 volt line 176, the common line 154, and control lines 178 and 180 which control operation of the motor control unit 146. Normally open push button switches 182 and 184 are connected between power line 162 and respective inputs of the count logic circuit unit 172 for providing a "START" signal and a "CROP CUT" signal, respectively, to the unit 172. A pulse generator 186 mounted on the shaft of the motor 68 has an input connected to the −15 volt line 176 by a resistor 188 and has an output connected to an input of the unit 172 for applying pulses to the unit 172 during rotation of the motor 68; one suitable pulse generator employs an apertured disk on the rotating shaft with a light emitting diode on one side of the disk and a photo-transistor on the other side of the disk.

The count logic circuit 172 contains a counting circuit which is preset by the start switch 182 to a predetermined count and used to count pulses from the generator 186 to measure a length of the slide fastener chain 10 in accordance with the setting of the counter in the unit 172. The winding of the relay 136 is connected on one side to the power line 162 and on its opposite side to an output 190 of the logic unit 172 for being operated when the crop cut switch 184 is operated or when the predetermined length of the slide fastener stringer 10 has been measured. A diode 192 is connected across the relay winding 136 for providing a current path for induced current when the relay 136 is de-energized.

An electrical mechanical counter 194 is connected between the lines 190 and 162 for being stepped when the relay 136 is operated. A diode 196 is also coupled across the counter winding 194 to prevent voltage surges during de-energization of the winding 194. The counter 194 has contacts 198 which are normally closed when the count in the counter 194 is greater than 0 and which are connected in series with toggle switch 200 having a normally open position for "HAND" operation and a normally closed position for "AUTOMATIC" operation, connected between the power line 162 and an input of the circuit unit 172. The counter 194 is settable to a count corresponding to the desired number of spaced operations are to be performed on the slide fastener chain 10.

The logic unit 172 contains control circuitry for automatically resetting the electronic measuring counter therein to automatically recycle the circuit until the number of operations set in the counter 194 have been preformed. Normally open contacts 202 of the counter 194 are connected from the junction of the toggle switch 200 and the contacts 198 to one side of a "BATCHED" indicator lamp 204 having its other side connected to the common line 154 to indicate when counter 194 reaches zero and the predetermined number of operations on the slide fastener chain have been performed.

The logic unit 172 is designed to produce an alternating current on line 178 which results in an alternating current being applied to motor 68 to lock the motor 68 in a stopped position, and to generate an analog votage on line 180 which determines the speed of the motor 68 when the motor 68 is operated. Conveniently the alternating current on line 178 is produced from feedback signals from generator 186 as it is oscillated slightly by the motor 68.

In operation of the apparatus of FIG. 1 by the control circuitry of FIG. 4, the power switch 90 is closed which applies power to lines 110 and 112 and the motor control unit 146 which applies a voltage to line 152. The start push button switch 160 is depressed to energize the line 162 and the relay 104 which closes contacts 102 to operate start relay 96 which in turn closes contacts 94 operating the motor 62. The motor 62 driving the capstan wheel 60, FIG. 1, rotates continuously during operation of the apparatus. Operation of the relay 104 also closes the holding contacts 164 maintaining the relay 104 energized until the stop switch 158 is depressed or the end of reel switch 50 opens. Also contacts 150 of the relay 104 close which enables the energization of the motor 68 by the motor control circuit unit 146. Operation of the start relay 96 closes contacts 116 to enable operation of the brake 32, closes contact 132 to connect the capacitance bank 134 across the output of the rectifier 126 so that the capacitance bank 134 is charged, and opens contacts 144 which disconnects the resistance discharge path for the capacitance 134.

With the toggle switch 200 in the "HAND" or open position, the "CROP CUT" push button switch 184 may be momentarily depressed which causes the logic unit 172 to operate the relay 136 which opens contacts 130 disconnecting the charging circuit for the capacitors 134 and closes contacts 138 connecting the capacitors 134 across the solenoid 72. The solenoid 72 is energized driving the ram 74 down and cutting the slide fastener chain 10, and/or performing another operation, such as gapping, on the slide fastener chain.

The start push button 182 is then depressed resulting in the setting of the electronic counting circuitry in the logic unit 172 and initiation of the operation of the motor control circuit 146 and operation of the motor 68 to rapidly accellerate the the advancing mechanism 20. The generator 186 produces pulses during the rotation of the motor 68, and after the number of pulses from pulse generator 186 have been counted indicating that the predetermined length of slide fastener chain 10 has been advanced, the motor 68 and advancing mechanism 20 is rapidly decellerated and stopped with the motor 68 being locked by the alternating current from the control unit 146. The relay 136 is then operated to result in the performing of an operation on the slide fastener chain by means of the mechanism 22.

When the toggle switch 200 is in the "AUTOMATIC" or closed position and the counter 194 is set to a predetermined number resulting in the closing of the contacts 198 and the opening of the contacts 202, the depression of the start switch 182 results in repeated operations of the count logic circuit 172 due to the logic high signal applied through switches 200 and contacts 198 to the unit 172. Thus the number of operations set in the counter 194 are automatically and rapidly performed. When the count in the counter 194 reaches zero, the contacts 198 open and the contacts 202 close causing the lamp 204 to illuminate indicating that the batch of operations on the slide fastener stringer 10 have been performed. Thereafter the count of the electronic circuitry in the logic unit 172 can be changed by means of thumb wheel switches in the face of the box 24 to change the spacing or length of advancement of the slide fastener chain between successive operations by the mechanism 22. The batch counter 194 can be reset and the start switch 192 depressed to begin another automatic cycle of operation.

During the advancing of the slide fastener chain 10 by the mechanism 20, excessive tension of the chain 10 on the advancing mechanism 20 is prevented by the capstan wheel 60 which grips and advances the chain 10 at a faster velocity than the mechanism 20 when the tension increases. This overcomes slippage in the mechanism 20 resulting from inertia of the reel 36 and insures accurate and reliable spacing between operations on the slide fastener chain 10. Utilizing the first loop forming mechanism 16 with the switch 56 to operate the brake 32 only when the first loop in the chain reaches a maximum size, permits rapid accelleration and incremental advancement as well as rapid decelleration permitting a relatively larger number of operations to be performed per unit time. Optimum varable rotational speed of the reel 36 is thus maintained.

Figure 3:
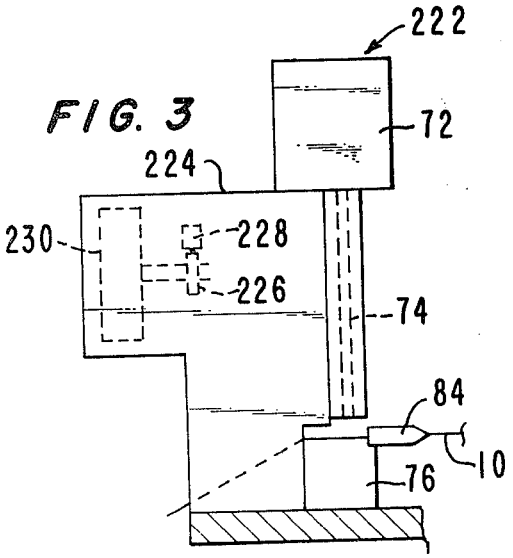
FIG. 3 is an elevation view of a modified mechanism at an operating station.
Figure 5:
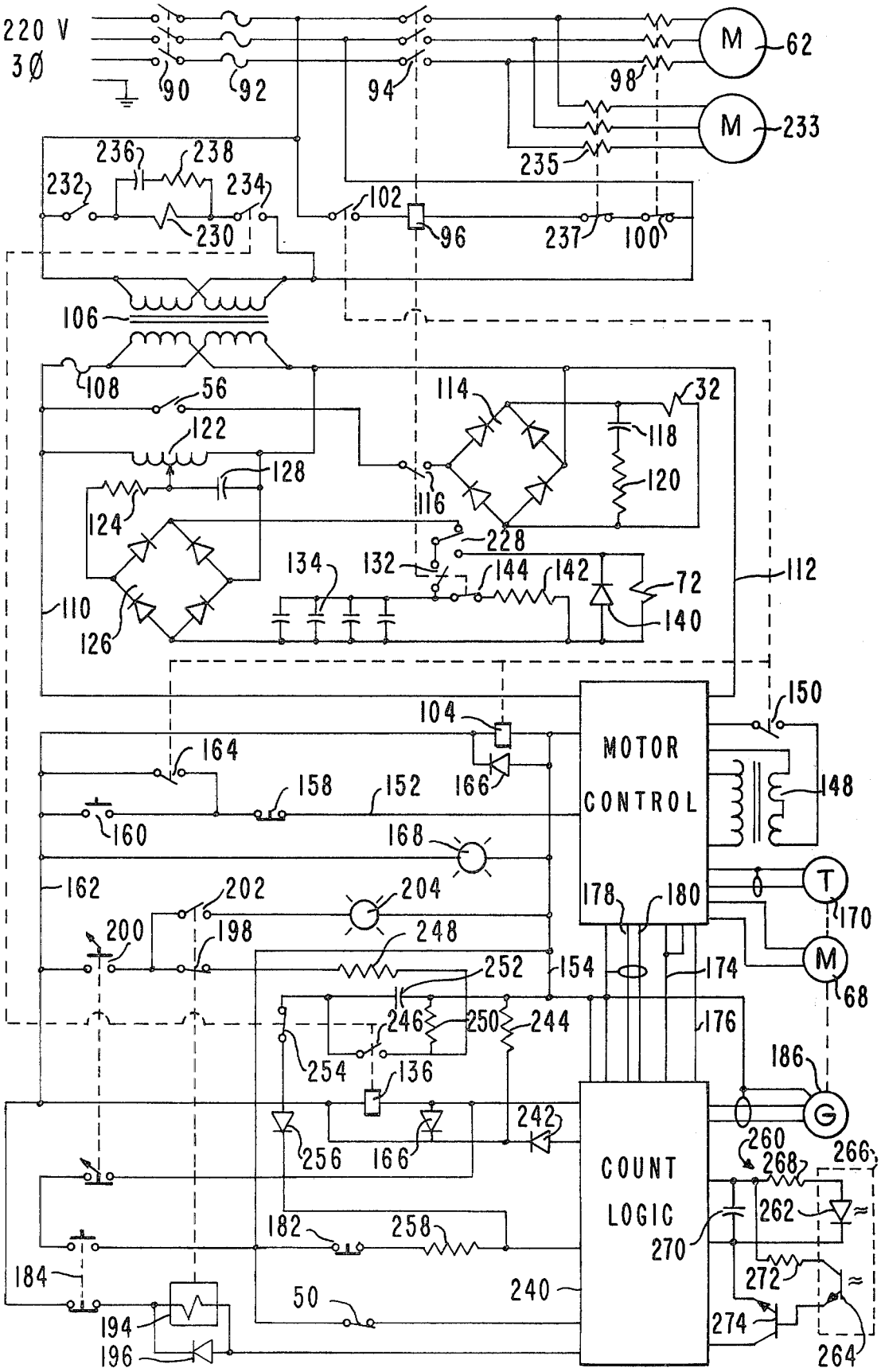
FIG. 5 is a diagram of a modified electrical circuit for operating an apparatus including the modification of FIG. 3.

A modified operating mechanism, indicated generally at 222 in FIG. 3, can be substituted for the operating mechanism 22 of FIG. 1, and a modified electrical circuit shown in FIG. 5 can be used in place of the electrical circuit of FIG. 4. Numbers used to identify parts in FIGS. 1 and 4 are used to identify parts in FIGS. 3 and 5 indicating that such parts are substantially similar in structure and operation. The operating mechanism 222 includes a conventional bottom stop stapling machine 224 to which a cam 226 and a switch 228 operated by the cam have been added. The cam 226 is mounted on the shaft from the conventional one revolution solenoid operated clutch 230 which is driven by a motor 233 connected to the output side of the start relay contacts 94 by a protective unit 235 which has normally closed contacts 237 in series with the start relay winding 96. The cam 226 is selected to operate the switch 228 during the operation of the clutch 230, and as shown in FIG. 5, is a single pole double throw switch with the arm thereof connected to contacts 132 for charging the capacitors through the normally closed contact of the switch 228 and with the normally open contact of the switch 228 connected to the solenoid 72 for operating the ram 74, FIG. 3, to cut the slide fastener chain 10, or perform another operation on the slide fastener chain. The relay 136 has normally open contacts 232 and 234 connecting the opposite sides of the solenoid winding for the clutch 230 across one phase of the input power lines. A capacitance 236 and resistance 238 are connected across the solenoid 230 for preventing arcing across the contacts 232 and 234 when the solenoid 230 is denergized.

The circuitry of FIG. 5 contains a modified count logic circuit unit 240, such as model number 234 from Introl Design Inc. which differs slightly from the count logic circuit unit 172 of FIG. 4 and includes facilities for automatically shortening the length of slide fastener chain being measured in the event that a splice is detected in front of the advancing mechanism. The start and crop cut inputs to the logic unit 240 are operated by logic lows rather than logic highs, and the unit 240 has an input responsive to the end of reel switch 50 for terminating operation of the motor 68 until a new reel can be installed and spliced to end of the slide fastener chain from the old reel. A diode 242 connects an input of the unit 240 to the line 162 for initially setting the count of the electronic counters in the unit 240 to 0 when the power is initally applied to the circuit and before the "ON" push button switch 160 has been pressed. A resistance 244 is connected from the line 162 to the common line 154 to insure that the line 162 is low when power is initally applied to lines 110 and 112.

The counting logic unit 240 does not contain an input for automatic operation and thus normally open contacts 246 of the relay 136 are connected on one side to the midpoint of a voltage divider formed by resistors 248 and 250 between the contacts 198 and the common line 154. The other side of the contacts 246 is connected to one side of a capacitance 252 which has its other side connected to the common 154. The positive side of the capacitance 250 is connected by normally closed contacts 254, of the relay 136, and a diode 256 to the start input of the unit 240. The diode 256 is isolated from the start switch 182 (normally closed in FIG. 5) by a resistance 258. When the relay 136 operates, the discharge of the capacitance 252 will bring about automatic cycling of the logic unit to restart the logic unit 240 when the contacts 254 close.

Separate outputs are provided on the unit 240 for operating the relay 136 and the batch counter 194. The unit 240 does not have an input for the "CROP CUT" switch. Thus the circuit of FIG. 5 utilizes a series circuit of normally open contacts of the switch 184 and normally closed contacts of the toggle switch 200; this series circuit is connected between the common line 154 and the junction between the relay 136 and the corresponding output of the unit 240. The "CROP CUT" switch 184 has an additional set of normally closed contacts connected in series with the counter 194 for preventing operation of the counter when the switch 184 is operated.

A splice detecting unit indicated generally at 260 includes a light emitting diode 262 and a photo transistor 264 in a unit 266 designed to be mounted between the pulley 64 and advancing mechanism 20 by conventional means (not shown). The diode 262 is connected by series protective resistance 268 across outputs of the unit 240 which have a filter capacitance 270 connected thereacross. The phototransistor 264 has its collector connected by a protective resistance 272 to the output of unit 240 joined to the resistance 268, and has its emitter connected to the base of a transistor 274 which has its emitter and collector connected to the other output and a splice input, respectively, of the unit 240. The phototransistor 264 senses light reflected by a reflective splicing tape from the diode 262 to apply a low to the splice input of unit 240. The unit 240 contains decade switches and logic circuitry which automatically preset the electronic counter therein when a signal is present on the splice input. This produces a count in the electronic counters so that the advancing mechanism stops advancing the chain when the splice is adjacent the operating mechanism 222. Also the unit 240 contains circuitry for preventing operation of the counter 194 during a shortened advancing step caused by the sensing of a splice.

Since many modifications, variations and changes in detail maybe made to the described apparatus and method, it is intended that all matter described in the foregoing description and shown in the accompanying drawings be interpeted as illustrative and not in a limiting sense.

What is claimed is:

1. A method of feeding a slide fastener chain and performing an operation on the chain at a work station, comprising the steps of:

passing the chain from a freely rotatable reel through a first loop of variable length around a movable roller, biasing the movable roller toward a position forming a maximum size of the first loop, passing the chain from the first loop through a second loop around an engaging surface of a capstan wheel, intermittently advancing the chain from the second loop to the work station, rotating the capstan wheel at a speed which advances the engaging surface at a speed faster then the movement of slide fastener chain during the advancing from the second loop, sensing when the first loop reaches a maximum size, braking rotation of the reel only in response to sensing of the maximum size of the first loop, and performing an operation on the slide fastener chain at the work station during a dwell period of the intermittent advancing.

2. A method as claimed in claim 1 including sensing an end of the slide fastener chain from the reel to stop the advancing.

3. A method as claimed in claim 1 including, sensing a splice in the slide fastener chain, and changing the advancing step so that the splice is stopped adjacent the work station in response to the sensing.

4. A method as claimed in claim 1 wherein the performing an operation includes cutting of the slide fastener chain.

5. A method as claimed in claim 1, 2, 3, or 4 wherein the performing an operation includes applying a bottom stop to a section of the slide fastener chain by means of a stapling machine.

* * * * *